US011484768B2

(12) United States Patent
Chau

(10) Patent No.: US 11,484,768 B2
(45) Date of Patent: Nov. 1, 2022

(54) EVENT MANAGEMENT SYSTEM, TIME MANAGEMENT SYSTEM, AND METHOD OF USE

(71) Applicant: Dung Chau, Stafford, TX (US)

(72) Inventor: Dung Chau, Stafford, TX (US)

( * ) Notice: Subject to any disclaimer, the term of this patent is extended or adjusted under 35 U.S.C. 154(b) by 100 days.

(21) Appl. No.: 17/019,572

(22) Filed: Sep. 14, 2020

(65) Prior Publication Data

US 2022/0080286 A1 Mar. 17, 2022

(51) Int. Cl.
*A63B 71/06* (2006.01)

(52) U.S. Cl.
CPC .... *A63B 71/0669* (2013.01); *A63B 2220/808* (2013.01); *A63B 2225/20* (2013.01); *A63B 2225/50* (2013.01)

(58) Field of Classification Search
CPC ..... A63B 71/0669; A63B 2220/808; A63B 2225/20; A63B 2225/50
USPC ..... 700/92
See application file for complete search history.

(56) References Cited

U.S. PATENT DOCUMENTS

| | | | | |
|---|---|---|---|---|
| 9,129,153 | B2 * | 9/2015 | Ianni | H04M 1/725 |
| 9,502,018 | B2 * | 11/2016 | Cronin | G04G 21/00 |
| 9,555,310 | B2 * | 1/2017 | Aman | A63B 71/0669 |
| 2006/0109089 | A1 * | 5/2006 | Boehm | G04F 10/00 340/326 |
| 2012/0002509 | A1 * | 1/2012 | Saguin | G08C 23/02 368/3 |
| 2013/0120123 | A1 * | 5/2013 | Aman | G09F 9/301 340/323 R |
| 2018/0280783 | A1 * | 10/2018 | Gordon | G06F 3/0488 |

FOREIGN PATENT DOCUMENTS

| | | | | |
|---|---|---|---|---|
| CA | 2695959 | A1 * | 10/2011 | A63B 71/0669 |

* cited by examiner

*Primary Examiner* — Allen Chan

(57) ABSTRACT

An event management system and/or time management system is presented. The present disclosure relates generally to management of a sporting event. More specifically, the present disclosure is a system and method for the management of a sporting event reducing risks associated with inaccuracies and health hazards. In the present disclosure an event management system and method for implementing controls to protect workers and athletes from identified health hazards. Additionally, and without limitation, the present disclosure provides a system which is more accurate than conventional manual controls and provides real time evaluations of accuracy and reporting of the event.

19 Claims, 4 Drawing Sheets

EVENT MANAGEMENT SYSTEM, TIME MANAGEMENT SYSTEM, AND METHOD OF USE

FIELD OF THE DISCLOSURE

The present disclosure relates generally to management of a sporting event. More specifically, the present disclosure is a system and method for the management of a sporting event reducing risks associated with inaccuracies and health hazards. In the present disclosure an event management system and method for implementing controls to protect workers and athletes from identified health hazards. Additionally, and without limitation, the present disclosure provides a system which is more accurate than conventional manual controls and provides real time evaluations of accuracy and reporting of the event.

COPYRIGHT NOTICE

At least a portion of the disclosure of this patent document contains material that is subject to copyright protection. The copyright owner has no objection to the facsimile reproduction by anyone of the patent document or the patent disclosure, as it appears in the Patent and Trademark Office patent files and/or records, but otherwise reserves all copyright rights whatsoever. The following notice applies to the software and data as described below and in the drawings that form a part of this document: Copyright Sideline Interactive LLC. All rights reserved.

BACKGROUND OF THE DISCLOSURE

Sports and other public entertainment events are old and well known in the art. Some of the more famous and/or early sporting events involved gladiators performing in front of large audiences during the time of the Roman Empire. Modern sporting events and entertainment events are performed in state of the art facilities, which can house 100,000 people or more. In fact some sporting venues can hold nearly a quarter million spectators. In many events, time management is important. This is not only true for events with large attendance but also for events that may have no attendance at all.

Sports, as an example of an event, are contests which are generally competitive and are generally physical. These contests are pursued for the goals and challenges of their respective sporting type. Sports vary from culture to culture and each culture has its own definition of sports and/or sporting events. An example of some sporting events may be a basketball game, a football game, a baseball game, a tennis match, a soccer game, a boxing match, a golfing event, bullfighting, cricket, figure skating, chess, hockey, field hockey, lacrosse, and more.

Most sports are considered a type of constrained play and one of the common constraints placed on sports are time. Another common constraint is a boundary. Time is generally a very critically important boundary placed on sports. This type of regulation exists for the purpose of providing an ending to an event and for having a playing field and/or even level of play for the competitors. Many other rules, in addition to time and boundaries exist and typically a sport will have a set of rules. In fact, the original rules of basketball, which have tremendous value and are housed at The University of Kansas, were originally written by Dr. James Naismith over 100 years ago; these rules are now hundreds of pages long. In this way, sports and organized play events can be competitive games with clear rules for determining winners and contests.

Many competitive sports are very dependent on time. Games and/or matches and/or contests usually have a specified length of time for the overall game play and duration. Additionally, many sporting events have a set of quarters, halves, and the like in which the clock and/or duration of time will pause for player rest and the like. Furthermore, some sports have pauses in game play in the event of substitutions, out of bounds, and/or other rules that may pause game play and subsequently pause the clock.

Complicating matters further, some games and/or sports and/or events have multiple clocks and or durations of time in which the durations of time provide rules for game play. As one example, basketball has an overall game clock which is broken into quarters or halves. The overall game clock pauses for substitutions, time outs, out of bounds, and at other times during game play. Additionally, a second clock exists in basketball which is a shot clock. In this way, and in some basketball rules at various levels, a shot clock is set for a duration of time in which a specified team is allowed to have possession of a basketball before turning possession of the basketball over to another team. For a more specific example, a game clock may be broken into 12 minute quarters for a total of a 48 minute game, or the game clock may be broken into two 20 minute halves for a total duration of 40 minutes of game play. In addition to the operation of a game clock, a basketball game may also include a shot clock. A shot clock will have an independent duration which is reset frequently. For example, the shot clock may be only 24 seconds per possession by each team. Another example of a third clock which can exist in a game is a half court clock. A half court clock may be only 8 seconds or the like. In this way, three clocks may operate simultaneously such that a half court clock is ticking, while a possession and/or shot clock is ticking, while a game clock is also ticking. In this way, the management of a game and/or the management of game clocks and timing can be complex and difficult. Especially when accuracy is so important. This is just one example of a sport with a clock. Other examples include the time to serve clock in tennis, the game clock and play clocks in football, the clock for injury time in soccer, the pitch clock in baseball, the timing clocks in orchestra, the synchronization clocks in other live performances, and the like.

In conventional sports, such as basketball, clocks are stopped and started by the blow of a whistle. The blow of the whistle is usually conducted by a referee and/or official of the game. In this way, the referee can signal to a game clock manager that the game clock manager should start and/or pause the game clock. The whistle is an indicator to the game clock manager. In this way, the game clock official, and the in game official, as two different people, must coordinate the clock through whistle blows.

Accuracy is very important in a sporting event. Oftentimes sporting events come down to plays which happen in the final seconds and/or shots and/or plays that take fractions of seconds. Oftentimes a games outcome will come down to the accuracy of those managing the game clock. In this way, the coordination of the officials and the whistle blows are critical. This is oftentimes even more complex in sporting events that have a crowd.

Crowds are often loud, drowning out whistles and whistle sounds may be difficult to hear and or make when a referee is running, breathing, and conducting other game management activities. For this reason, and more, accuracy in game clock management and time management of an event is problematic. Human error is very prominent both through unwarranted error but can even be affected due to communication factors, environmental factors, and other human factors such as reaction delay, and the like.

Health and safety are also problematic in whistle blowing, as an effective means of gameplay starting, stopping, pausing, and switching, and the like. Whistle blowing, the act of a human using a conventional whistle to make a sound at a particular frequency, emits saliva. Said another way, a conventional whistle effectively acts in a means of turning saliva into an aerosol. This is especially concerning given that viruses and other bacteria, and the like can be carried through the air and spread through droplets of saliva. Especially concerning is that influenza and coronavirus can be spread through water droplets. For this reason, and in order to control spread of disease, viruses, and bacteria, and need for an effective whistle and/or communication system that does not emit saliva in the form of an aerosol is desirable in the art for official and player safety, and others within a proximity.

One example is that officials are also employees, like paid athletes and the like. Said another way, the Environmental, Health and Safety (EHS) industry is well known in the art. Generally, Environmental Health and Safety is the implementation of practices to manage work environments and make the workplace and/or work environment safer. Said another way, the implementation of health and safety practices for a workplace are for the purpose of making sure work activities do not cause harm to anyone. For this reason, a safer communication and whistle system is desirable.

Organized efforts, from a top down approach are often necessary to create a safe environment. Thus, the safety portion of environmental health and safety comes into play. From the safety standpoint, an organization creates practices and procedures for various types of work environments which prevent and/or reduce the risk of harm that can come to the workers, and others, in a particular environment.

Thus, there exists a need in the art for a safer environment for players, officials, coaches, fans, and the like. Additionally, there exists a need in the art for a more effective, accurate, easy to use, fun to use, safe to use, and timely clock and event management system. Thus, the present disclosure provides a more timely, effective, accurate, safe, and easy to use system for time management of an event, such as a sporting event.

SUMMARY OF THE DISCLOSURE

The present disclosure serves officials, players, coaches, sporting event staff, and others in the industry to provide solutions for these problems and more. Said another way, the present disclosure relates generally to management of a sporting event. More specifically, the present disclosure is a system and method for the management of a sporting event reducing risks associated with inaccuracies and health hazards. In the present disclosure an event management system and method for implementing controls to protect workers and athletes from identified health hazards. Additionally, and without limitation, the present disclosure provides a system which is more accurate than conventional manual controls and provides real time evaluations of accuracy and reporting of the event.

The present disclosure is an event management system, time management system, and method of use to provide a safe and accurate time tracking and time clock control device. Said another way, the present disclosure provides a system and method of use for stopping and starting a game clock in a more accurate way, without multiple human involvement and in a more efficient means. In other words, the present disclosure provides a system which allows for the remote control of the game clock by an official without interaction with a second official located at a time clock control and/or in a remote booth and/or location.

The present disclosure provides a solution to the problems existing in the art, the problems outlined herein, and many more. In other words, for the first time, the present disclosure provides a solution to the time accuracy issues that plague the state of the art. Additionally, and in a heightened environment where pandemic and disease spread, the present disclosure provides a solution to the spread of disease and environmental health and safety hazards.

Thus, it is a primary object of the disclosure to provide an event system, time management system, and method of use that improves upon the state of the art.

Another object of the disclosure is to provide an event system, a time management system, and methods of use that provides accuracy in the time management of a sporting event and/or other event Yet another object of the disclosure is to provide an event management system, a time management system, and methods of use that improves upon the safety of those involved.

Another object of the disclosure is to provide an event management system, a time management system, and methods of use that manages a game clock.

Yet another object of the disclosure is to provide an event management system, a time management system, and methods of use that manage a shot clock.

Another object of the disclosure is to provide an event management system, a time management system, and methods of use that replaces a conventional whistle.

Yet another object of the disclosure is to provide an event management system, a time management system, and methods of use that work nearly instantaneously.

Another object of the disclosure is to provide an event management system, a time management system, and methods of use that eliminates the need for a shot clock operator.

Yet another object of the disclosure is to provide an event management system, a time management system, and methods of use that eliminates manual intervention.

Another object of the disclosure is to provide an event management system, a time management system, and methods of use that reduces error.

Yet another object of the disclosure is to provide an event management system, a time management system, and methods of use that reduces lag in clock management.

Another object of the disclosure is to provide an event management system, a time management system, and methods of use that detect a referee whistle.

Yet another object of the disclosure is to provide an event management system, a time management system, and methods of use that can work with a conventional whistle system.

Another object of the disclosure is to provide an event management system, a time management system, and methods of use that detect a predetermined frequency.

Yet another object of the disclosure is to provide an event management system, a time management system, and methods of use that transmits a wireless signal to a scoreboard controller.

Another object of the disclosure is to provide an event management system, a time management system, and methods of use that stops a clock immediately.

Yet another object of the disclosure is to provide an event management system, a time management system, and methods of use that is automated.

Another object of the disclosure is to provide an event management system, a time management system, and methods of use that improves fairness in sports.

Yet another object of the disclosure is to provide an event management system, a time management system, and methods of use that improves accuracy in sports.

Another object of the disclosure is to provide an event management system, a time management system, and methods of use that detect a key whistle frequency.

Yet another object of the disclosure is to provide an event management system, a time management system, and methods of use that ignores sounds of false whistles.

Another object of the disclosure is to provide an event management system, a time management system, and methods of use that works with multiple systems produced by various manufacturers.

Yet another object of the disclosure is to provide an event management system, a time management system, and methods of use that can be retrofit to existing systems.

Another object of the disclosure is to provide an event management system, a time management system, and methods of use that work without the need for a whistle.

Yet another object of the disclosure is to provide an event management system, a time management system, and methods of use that are coronavirus friendly.

Another object of the disclosure is to provide an event management system, a time management system, and methods of use that prevents the spread of viruses, germs, and other infectious diseases.

Yet another object of the disclosure is to provide an event management system, a time management system, and methods of use that utilizes a mouthguard.

Another object of the disclosure is to provide an event management system, a time management system, and methods of use that activates when an official or user bites down on a mouth guard.

Yet another object of the disclosure is to provide an event management system, a time management system, and methods of use that activate via a handheld trigger.

Another object of the disclosure is to provide an event management system, a time management system, and methods of use that easily integrate an external trigger device.

Yet another object of the disclosure is to provide an event management system, a time management system, and methods of use that easily integrate with external horn devices.

Another object of the disclosure is to provide an event management system, a time management system, and methods of use that easily integrate with backboard lights and/or other visual indicators.

Yet another object of the disclosure is to provide an event management system, a time management system, and methods of use that provide a digital log of information.

Another object of the disclosure is to provide an event management system, a time management system, and methods of use that provide a log of events.

Yet another object of the disclosure is to provide an event management system, a time management system, and methods of use that easily upload to a data stream.

Another object of the disclosure is to provide an event management system, a time management system, and methods of use that seamlessly integrate with other applications.

Yet another object of the disclosure is to provide an event management system, a time management system, and methods of use that integrate with a console host.

Another object of the disclosure is to provide an event management system, a time management system, and methods of use that integrate with a console host without any disruption to the console host.

Yet another object of the disclosure is to provide an event management system, a time management system, and methods of use that send identical signals to signals which are sent in the existing system.

Another object of the disclosure is to provide an event management system, a time management system, and methods of use that utilizes a camera to detect hand signals from an operator.

Yet another object of the disclosure is to provide an event management system, a time management system, and methods of use that use a set of rules to stop or start a clock.

Another object of the disclosure is to provide an event management system, a time management system, and methods of use that integrate a microphone to detect when a whistle is blown.

Yet another object of the disclosure is to provide an event management system, a time management system, and methods of use that utilizes a belt pack.

Another object of the disclosure is to provide an event management system, a time management system, and methods of use that can automatically stop a clock when a whistle is blown.

Yet another object of the disclosure is to provide an event management system, a time management system, and methods of use that can automatically start a clock when a whistle is blown.

Another object of the disclosure is to provide an event management system, a time management system, and methods of use that can be wired or wireless.

Yet another object of the disclosure is to provide an event management system, a time management system, and methods of use that use vibration as indicators.

Another object of the disclosure is to provide an event management system, a time management system, and methods of use that are easy to use.

Yet another object of the disclosure is to provide an event management system, a time management system, and methods of use that are safe to use.

Another object of the disclosure is to provide an event management system, a time management system, and methods of use that are high quality.

Yet another object of the disclosure is to provide an event management system, a time management system, and methods of use that are accurate.

Another object of the disclosure is to provide an event management system, a time management system, and methods of use that are user friendly.

Yet another object of the disclosure is to provide an event management system, a time management system, and methods of use that last long durations of time.

Another object of the disclosure is to provide an event management system, a time management system, and methods of use that are robust.

Yet another object of the disclosure is to provide an event management system, a time management system, and methods of use that can be used with a mobile device.

These and other objects, features, or advantages of the present disclosure will become apparent from the specification and claims.

DETAILED DESCRIPTION OF THE DISCLOSURE

Figure 1:
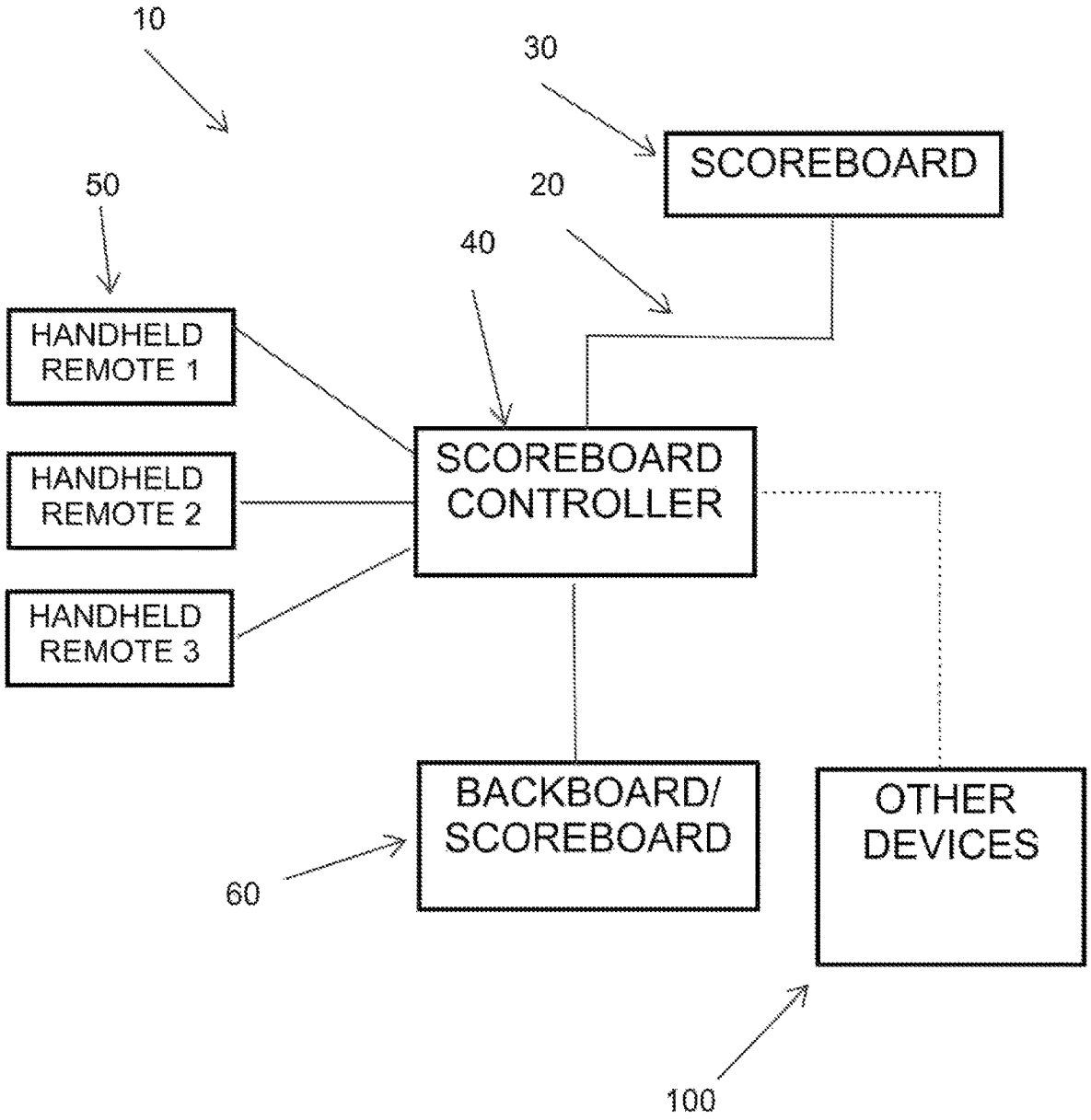
FIG. 1 is a diagram illustrating the various phases and parts of the system; the view showing various parts of the systems and interactions of the system; the view showing signal pathways of a system; the view showing a scoreboard; the view showing a scoreboard controller; the view showing a plurality of handheld remotes; the view showing a backboard and/or scoreboard; the view showing other devices as they may be integrated.

In the following detailed description, reference is made to the accompanying drawings which form a part hereof, and in which is shown by way of illustration specific embodiments in which the disclosure may be practiced. These embodiments are described in sufficient detail to enable those skilled in the art to practice the disclosure, and it is to be understood that other embodiments may be utilized and that mechanical, procedural, and other changes may be made without departing from the spirit and scope of the disclosure(s). The following detailed description is, therefore, not to be taken in a limiting sense, and the scope of the disclosure(s) is defined only by the appended claims, along with the full scope of equivalents to which such claims are entitled.

As used herein, the terminology such as vertical, horizontal, top, bottom, front, back, end, sides and the like are referenced according to the views, pieces and figures presented. It should be understood, however, that the terms are used only for purposes of description, and are not intended to be used as limitations. Accordingly, orientation of an object or a combination of objects may change without departing from the scope of the disclosure.

Reference throughout this specification to "one embodiment," "an embodiment," "one example," or "an example" means that a particular feature, structure, or characteristic described in connection with the embodiment or example is included in at least one embodiment of the present disclosure. Thus, the appearance of the phrases "in one embodiment," "in an embodiment," "one example," or "an example" in various places throughout this specification are not necessarily all referring to the same embodiment or example. Furthermore, the particular features, structures, databases, or characteristics may be combined in any suitable combinations and/or sub-combinations in one or more embodiments or examples. In addition, it should be appreciated that the figures provided herewith are for explanation purposes to persons ordinarily skilled in the art and that the drawings are not necessarily drawn to scale.

Embodiments in accordance with the present disclosure may be embodied as an apparatus, method, or computer program product. Accordingly, the present disclosure may take the form of an entirely hardware-comprised embodiment, an entirely software-comprised embodiment (including firmware, resident software, micro-code, etc.), or an embodiment combining software and hardware aspects that may all generally be referred to herein as a "circuit," "module," or "system." Furthermore, embodiments of the present disclosure may take the form of a computer program product embodied in any tangible medium.

Any combination of one or more computer-usable or computer-readable media may be utilized. For example, a computer-readable medium may include one or more of a portable computer diskette, a hard disk, a random access memory (RAM) device, a read-only memory (ROM) device, an erasable programmable read-only memory (EPROM or Flash memory) device, a portable compact disc read-only memory (CDROM), an optical storage device, and a magnetic storage device. Computer program code for carrying out operations of the present disclosure may be written in any combination of one or more programming languages. Such code may be compiled from source code to computer-readable assembly language or machine code suitable for the device or computer on which the code will be executed.

Embodiments may also be implemented in cloud computing environments. In this description and the following claims, "cloud computing" may be defined as a model for enabling ubiquitous, convenient, on-demand network access to a shared pool of configurable computing resources (e.g., networks, servers, storage, applications, and services) that can be rapidly provisioned via virtualization and released with minimal management effort or service provider interaction and then scaled accordingly. A cloud model can be composed of various characteristics (e.g., on-demand self-service, broad network access, resource pooling, rapid elasticity, and measured service), service models (e.g., Software as a Service ("Saas"), Platform as a Service ("PaaS"), and Infrastructure as a Service ("IaaS")), and deployment models (e.g., private cloud, community cloud, public cloud, and hybrid cloud).

The flowchart and block diagrams in the attached figures illustrate the architecture, functionality, and operation of possible implementations of systems, methods, and computer program products according to various embodiments of the present disclosure. In this regard, each block in the flowchart or block diagrams may represent a module, segment, or portion of code, which comprises one or more executable instructions for implementing the specified logical function(s). It will also be noted that each block of the block diagrams and/or flowchart illustrations, and combinations of blocks in the block diagrams and/or flowchart illustrations, may be implemented by special purpose hardware-based systems that perform the specified functions or acts, or combinations of special purpose hardware and computer instructions. These computer program instructions may also be stored in a computer-readable medium that can direct a computer or other programmable data processing apparatus to function in a particular manner, such that the instructions stored in the computer-readable medium produce an article of manufacture including instruction means which implement the function/act specified in the flowchart and/or block diagram block or blocks.

All illustrations of the drawings are for the purpose of describing selected versions of the present invention and are not intended to limit the scope of the present invention.

Figure 2:
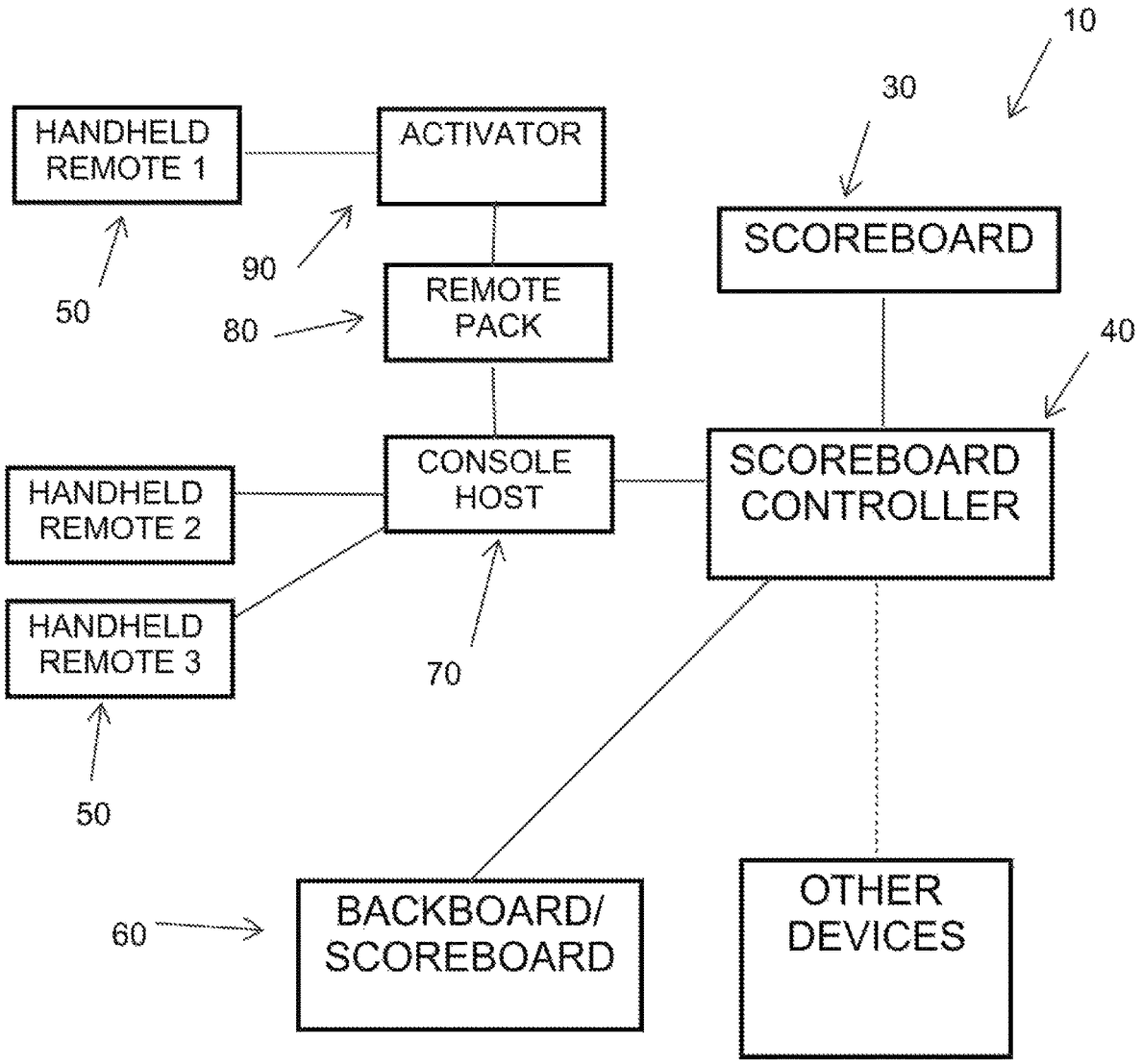
FIG. 2 is a diagram illustrating the various phases and parts of the system; the view showing various parts of the systems and interactions of the system; the view showing signal pathways of a system; the view showing a scoreboard; the view showing a scoreboard controller; the view showing a plurality of handheld remotes; the view showing a backboard and/or scoreboard; the view showing other devices as they may be integrated; the view showing a console host; the view showing a remote pack; the view showing an activator; the view showing additional features in an inline setup.
Figure 3:
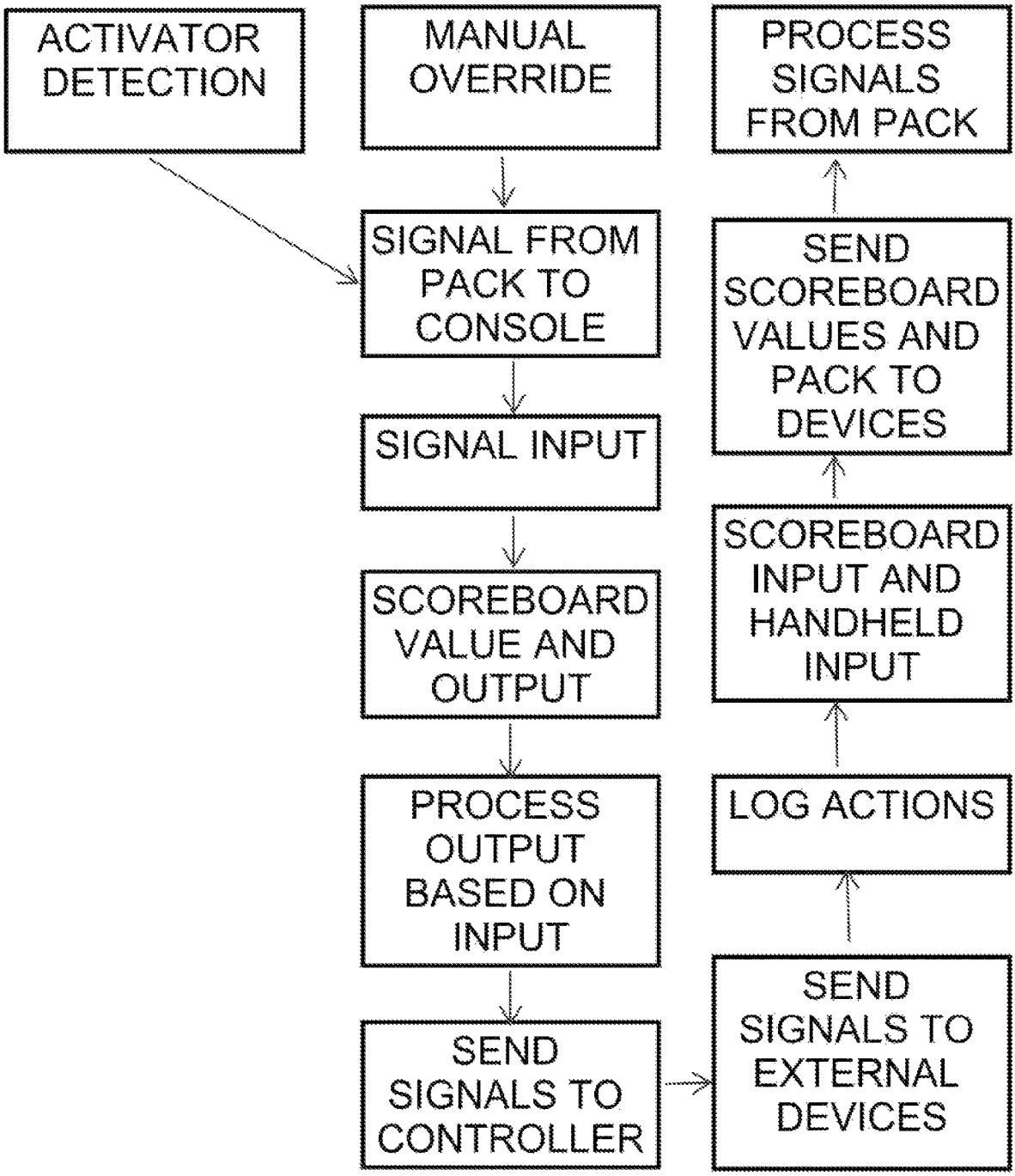
FIG. 3 is a diagram illustrating multiple processes of carrying out the methods herein; the view showing activator detection and manual override options for activation; the view showing a signal being activated from a pack to console; the view showing the signal input; the view showing the scoreboard value; the view showing an output; the view showing the processing of the output based on the input; the view showing the signal output being send to the controller; the view showing the signal being sent to external devices; the view showing the actions of the system being recorded; the view showing the scoreboard and handheld inputs; the view showing the scoreboard and handheld inputs being sent to the scoreboard as scoreboard values and pack and other devices; the view showing the processing of signals from the pack and/or belt pack.
Figure 4:
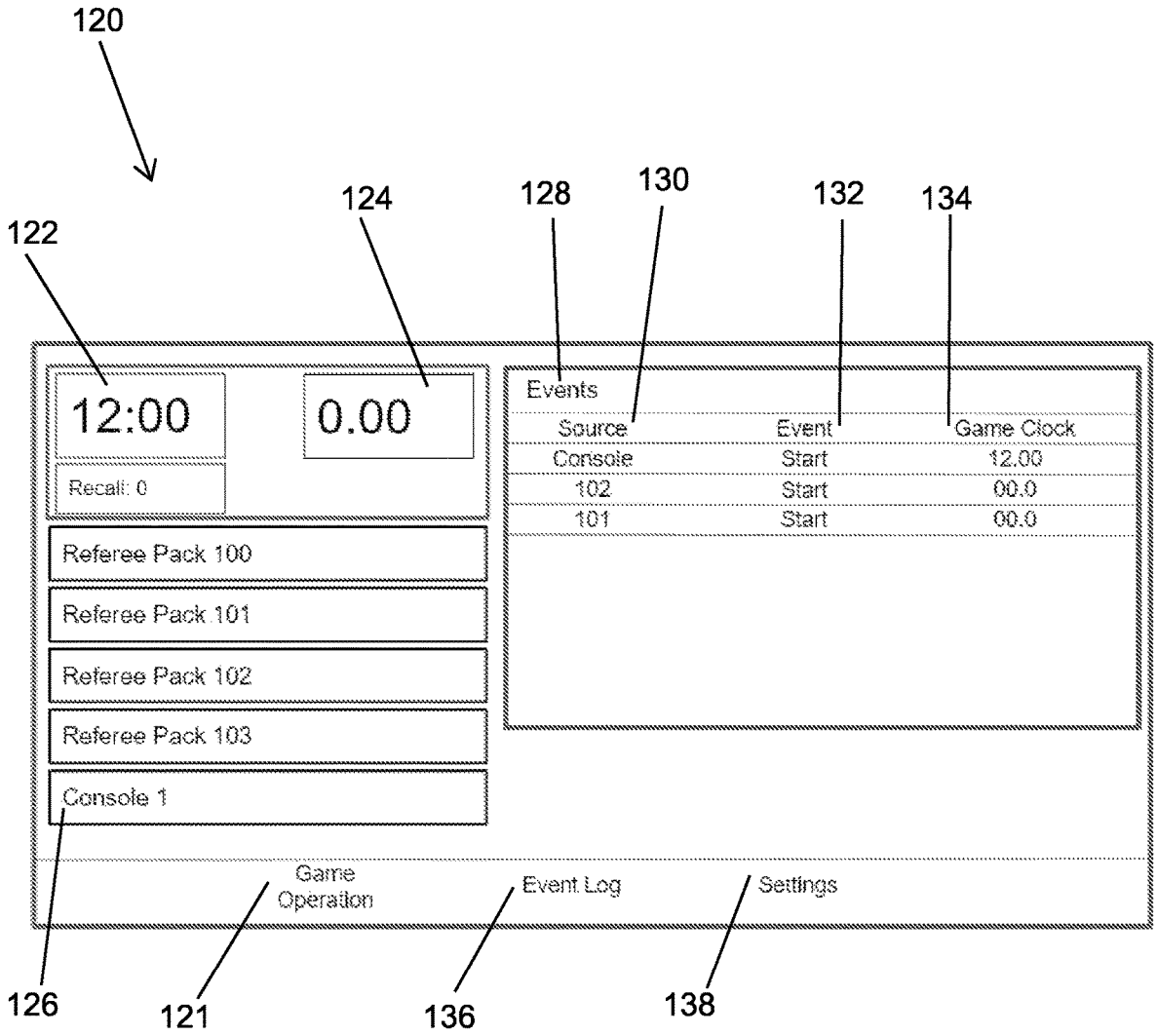
FIG. 4 is a view showing a graphical user interface; the graphical user interface displaying a time clock; the graphical user interface displaying a secondary clock; the graphical user interface displaying a plurality of packs within input capability; the view showing an event log; the view showing game operation functionality; the view showing an event log functionality; the view showing a settings variance.

The following descriptions are in reference to FIG. 1 through FIG. 4. The present invention is a system and method to manage the game clock and other clocks that may be associated with an event and/or may be associated with management of a sporting event. The present disclosure provides a system for detecting when a clock should be started or stopped and automatically stopping and/or starting that clock by sending a signal which activates the stopping and/or starting of the respective clock and/or timer.

Throughout the specification, a "user" may be a person or any entity who utilizes and/or engages with the systems disclosed herein and/or performs the methods and processes described herein; a user (or "individual", or "entity", or "company") may be any entity, professional, individual, worker, athlete, official, or referee, or the like, who are managing an event and/or managing a sporting event and/or managing a timer and/or clock associated within timing.

Additionally, the present invention is available in the form of a mobile application which can operate on a mobile device (such as a smartphone, a tablet, etc.) that possesses computing capability and network connectivity. It should be noted that entities and users may use an integrated application; however, separate applications, which are specifically designed for the entities and individual users respectively, may be provided. As used herein, the term "engine" is used to refer to collections of programs which are grouped based upon function.

The graphical user interface (or "GUI") engine generates graphical data for displaying a user interface which enables users and/or entities to interact with the present disclosure. A user can input information into the user interface and the graphical user interface engine relays the information to other engines for further processing. For example, the user interface may include a login box into which users can enter login credentials, and then the credentials are transmitted from the graphical user interface engine to the worker management engine for user authentication. If the login credentials do not match with those in the database, the graphical user interface engine will generate a pop-up window requiring the user to re-enter the credentials. In a preferred embodiment, the graphical user interface engine generates a graphical user interface showing a game clock, an event log of the game clock, and link with a plurality of controls, as well as show an interactive interface of the plurality of remote controls along with activation or locking, deactivation of the plurality of controls and the like. In this way, a user can control the entire system and/or manage the system from a single location by controlling what remotes are active, and the like. Additionally, a user can engage in manual overrides of the various functionality, including adjusting the game clock as may be needed from time to time.

In one embodiment, a user enters information related to the system, the number of remotes, the time limits for the clocks, and the various controls of a plurality of clocks and/or scores as may be available, through the graphical user interface. This information, or environmental information is stored in the memory of the management system and/or management engine. Additionally, the user may enter individual information related to the user and/or referee. The referee information and/or remote control information will be stored in a memory and processor by the remote control system and/or remote control engine.

The information stored and processed can then be uploaded to the database builder which also utilizes machine learning to create a set of rules which may be associated with a particular type of event and/or particular type of sporting game. The database and/or event builder provides a number of functions, such as but not limited to, a standardization of time classifications such as a typical set of quarters, halves, and time durations of such during a typical sporting event, interpolation of event information, understanding of officials and/or referees and the typical number of controls involved and how the various controls may interact and/or override one another, event condition assessments, provide various control recommendations, provide a review of this information, and generate a plurality of reports and or event logs. These features, other functionality, and components, and methods of use will become more clear in the specification herein.

Although the disclosure has been explained in relation to its preferred embodiment, it is to be understood that many other possible modifications and variations can be made without departing from the spirit and scope of the invention.

System

With reference to the figures, an event management system, a time management system 10, and platform, and methods of use are presented (hereafter known as "time management system", "clock management system", "timer system", or "clock system" or simply "system"). Clock management system 10 is formed of any suitable size, shape and design. In the arrangement shown, as one example, system 10, may comprise remote servers, databases, application servers, application databases, application programming interfaces, user databases, event databases, sports databases, sports rules databases, global positioning features, mobile applications, and/or computers that fulfill the functions disclosed herein.

In the arrangement shown, as one example, the disclosure presented herein is presented through the example of the sport of basketball and its primary functionality as would take place when integrated with this type of sporting event. This is done for ease of explanation. In no way, is the present disclosure limited to basketball. Basketball sport events just happen to have multiple clocks systems and in the professional ranks tend to have multiple referees on the court at a single time, so the sport caters well as an example of some of the functionalities of the disclosure herein.

Said another way, and through example, during a basketball game, there are two clocks that are used to track time; A primary clock and/or game clock as well as a shot clock. In this way, the team on offense, or in possession of the ball, must attempt to shoot the ball and/or score points prior to the expiration of the shot clock expiration. Generally a shot clock will range from a 24 second limit to a 35 second limit. In this way, the possession of the ball to a single team is limited to the duration of the shot clock before the possession is turned over and or the ball is rebounded after a scoring attempt.

In this example, and in this system, the referee and/or other official will signal by a blow of a whistle when the shot clock as expired. In conventional operation, the blow of the whistle by an on court referee will indicate to a shot clock operator on the side of the court that the shot clock has expired and that the shot clock should be reset and that the game clock should be stopped until possession is switched and the opposing team begins play with possession.

Unfortunately, in conventional operation the manual intervention involved and the coordination between multiple referees and a shot clock operator and/or a plurality of shot clock operators leads to errors. There is a lag of time that a shot clock operator responds to the whistle by an on court referee. This leads to errors in both the shot clock and the game clock and the time remaining in a game. This error can multiple greatly during the duration of a basketball game and/or other game.

The present disclosure, system 10, provides a system that attaches to the whistle and/or other activator of a referee that will detect the frequency and/or other activation methods utilized by the plurality of referees. The system will detect when a whistle has blown and will send a signal to the scoreboard controller and stop the clocks immediately. This is all automated through computer systems and electronic transmission such that lag is eliminated and the entire process can be completed in milliseconds. In this way, the present disclosure improves upon the fairness and accuracy of a basketball game and/or other event in which the system is utilized for managing time.

Said another way, and in the present disclosure, works by detecting a whistle frequency. The present disclosure is equipped with background sound detection and false whistle detection features. Furthermore, the present disclosure works with multiple scoreboard systems. Additionally, the present disclosure is designed to work with various manufacturers and can also work as a retro-fit system.

Additionally, the present disclosure, system 10, includes a whistle-less option and whistle-less module such that no whistle blowing is required to activate the system. In this way, system 10 is coronavirus-19 friendly and prevents the spread of infectious disease. Said another way, whistles are natural aerosol creators of human saliva. Whistles require spit and/or saliva to be emitted in order to create blowing of a whistle and a particular frequency. The present disclosure provides variations on the whistle requirement such that a handheld trigger and/or mouthguard with pressure detection. In this way, a plurality of other modules are disclosed herein which provide alternatives to whistles and prevent the potential spread of infectious disease and germs.

Furthermore, the present disclosure, system 10, as one example, provides a direct link to external devices from the handheld module and/or the activator. In this way, the mouthguard activator and/or handheld trigger system can send signals to a horn device, backboard lights and/or other visual indicators and/or other external devices as may be desired to have interactions with directly from the referee.

In the arrangement shown, as one example, system 10 also includes a logging feature. In this way a user can upload and/or integrate data into a stream of event logging and/or other applications. In this way, each event in the system can be tracked, added to a log, edited, printed and/or reported. Furthermore, in this way, the log can be used to evaluate referee performance for an event and the like. Furthermore, other users such as coaches and the like can use the log to track time on court, active time of players, and other various parameters that were previously unavailable to a user. These features and many more are presented herein.

System 10 also includes, in the embodiment depicted, a user, a plurality of accounts, a legend, a plurality of referees and/or a plurality of officials, may include a clock manager, may also include a plurality of players and/or a plurality of competitors, a plurality of wired connections 20 and/or a plurality of wireless connections 20, scoreboard 30, scoreboard controller 40, a plurality of handheld remotes 50, a plurality of backboards 60 and/or a plurality of time displays 60, a console host 70, a remote pack 80, an activator 90 and/or a plurality of activators 90, among other devices 100, and a graphical user interface 120, among other components, features, and functions.

In the arrangement shown, as one example, system 10 may comprise remote servers, databases, and/or computers that fulfill the functions disclosed and described herein. In the embodiment depicted, the event management system 10 may comprise a plurality of application servers. Application servers comprises one or more computer systems adapted to transmit and receive data regarding selected datasets related to various users and/or datasets related to multiple users and/or datasets related to various functionality and conditions and/or datasets related to sporting events and/or other information.

Application servers are adapted to query a plurality of databases with unique identification codes to retrieve a list of users and/or events and/or rules and/or generate reports related to various conditions. Application servers are also adapted to query a standardized database. Additionally, the application server may communicate with a mobile application, which is adapted to present the timing and sporting information in a form conducive to being viewed on a mobile device and/or handheld device.

The appearance of the presentation of the event management information and/or the time management information and/or the user information in the process windows for managing a plurality of time clocks and/or scenarios and/or events may be customized with data of particular relevance to the user and/or the event and/or the type of sporting event and/or event. As one example, the appearance of windows and/or the process for managing a plurality of remote control devices, the system may be customized for user information, entity information, remote control priority information, and/or other information related to timing of a plurality of clocks and data logging and reporting.

As one of ordinary skill in the art may understand, application server, event databases, and other databases mentioned herein may be implemented in one or more servers. Additionally, multiple servers may have mirrored data to prevent data loss in case of disk failure and/or to decrease access and response times for database queries. In alternative embodiments, application server, and other database procedures may be carried out on computer-readable instructions and data stored on the customer's mobile computing device. Additionally, system 10 includes an application programming interface ("API") which includes tools and resources enabling a user to operate the embodiments herein.

Connections:

In the arrangement shown, as one example, system 10 includes a plurality of connections 20 (also known as "wired connections" or "wireless connections", or simply "connections"). Connections 20 are formed of any suitable size, shape, and design and are configured to provide power to the various components of the system 10 and/or send signals and/or transmit frequencies to various components of system 10.

In the arrangement shown, as one example, both wired connections and wireless connections are considered. The connections 20 are primarily configured to provide power and provide communication. Communication is any form of wireless signals, or wired signals, through the air, such as a conventional remote signal, a cell phone, a wireless device, an internet connected device, a hard-wired device, or any other device capable of transmitting remote control signals. Said another way, earbuds may operate by bluetooth and/or other wireless signals which communicate with other devices.

In the arrangement shown, as one example, system 10 may also include a plurality of receivers and/or transceivers to carry out communications in system 10. A receiver is used if one way communication is utilized, whereas a transceiver is used if two-way communication is utilized (hereinafter "transceiver"). Receiver/transceiver is connected with an antenna, such as a monopole antenna, a loop antenna, a fractal antenna, or any other form of an antenna. Antenna receives wireless signals from any other device, transmits these signals to a receiver/transceiver which processes these signals and then transmits these processed signals to a microprocessor which processes these signals according to instructions stored in memory. In one arrangement, system 10 re-transmits operating commands signals through receiver/transceiver so as to similarly control over-the-air communication.

In the arrangement shown, as one example, each end may also include a processor and/or microprocessor to handle signal input and output. Microprocessor is any computing device that receives and processes information and outputs commands according to instructions stored in memory. Memory is any form of information storage such as flash memory, random access memory, memory, a hard drive, or any other form of memory. Memory may be included as a part of or operably connected to a microprocessor. A receiver/transceiver is connected to a microprocessor.

Furthermore, in the arrangement shown, as one example, an in-line coupler is utilized. In-line couplers may also be known as an in-line connection. In this way, the signals and frequencies being transmitted through the connections are uninterrupted. Said another way, the system 10 may also be sized, shaped, and designed as a retro-fit system and/or retrofit kit so that the system can be added to existing systems without interference and/or without the existing system knowing that system 10 has been integrated into and/or installed onto the existing system, such that system 10 can manipulate operation of an existing system.

Scoreboard:

In the arrangement shown, as one example, system 10 may also include a scoreboard 30. Scoreboard 30 is formed of any suitable size, shape, and design and is configured to display a plurality of visual indicators to audiences, officials, and others wishing to know about desired parameters of an event. In the arrangement shown, and by example of a basketball game, a scoreboard 30 will display the amount of time remaining in a quarter, half, or game. In the arrangement shown, as one example, the scoreboard 30 will also display the amount of time remaining on the game clock. In the arrangement shown, as one example, the scoreboard 30 will also display other information such as the score of the match, points per player, player names, foul counts, possession arrows and the like.

Said another way, a scoreboard 30 is commonly the main display at a sporting event. Modern scoreboards host LED (or light emitting diodes) to create recognizable patterns. Furthermore, very nice scoreboards 30 may be equivalent to television type screens with high definition displays and the like.

In the arrangement shown, as one example, a referee and/or other official can blow a whistle and/or trigger an activator such as to stop the clock on the scoreboard 30. In this way, once a referee triggers an activator (to be further discussed herein) the activator sends a signal to the host device which relays a signal to a scoreboard controller which will display scoreboard 30 parameters accordingly.

A conventional scoreboard operates via a scoreboard operator. Typically, a scoreboard operator sits directly in front of a scoreboard controller (to be further discussed herein). The scoreboard operator can start a game by inputting the game or sporting type, such as but not limited to, basketball, football, soccer, hockey, lacrosse, and other sporting events and the like. In this way, the scoreboard operator sets up configurations such as game clocks, shot clocks, team names, starting data values, and the like.

In the arrangement shown, as one example, and in the conventional scoreboard function, as the particular event and/or game progresses, the scoreboard operator will increment the points for each team, as each team scores points. Additionally, and in conventional operation, the scoreboard operator will start and/or stop the game clock based on queues from a plurality of officials. In conventional scoreboard operation, the scoreboard operator will manage these functions at the scoring table (on a sideline or commonly in a booth) throughout the duration of the game.

Furthermore, and in conventional scoreboard operations, such as in a basketball game, there is a second user who sits next to the scoreboard operator at the scoreboard table (on the sideline or commonly in a booth). The second scoreboard operator has a singular job of operating the shot clock. In basketball, a shot clock is generally short, less than 30 seconds. For this reason, the shot clock needs frequent management and/or operation from a second scoreboard operator.

In the arrangement shown, as one example, system 10 eliminates the need for a scoreboard operator because a handheld remote is provided to the on court referee. In this way, the referee can directly, and more accurately control the shot clock based on actions happening on the cour. In this way, the on court referee can more efficiently act as the shot clock operator. Furthermore, the referee can more accurately and easily used the handheld module, provided herein to start and/or stop and/or reset the shot clock.

The arrangement shown, and system 10, create these advantages and more, because as is shown in the example, the referee can control the game clock and the shot clock directly. In this way, two operators sitting on the sideline or elsewhere don't have to try to hear the referee's whistle (which is especially problematic in environments with crowds) nor do the operators have to try to watch multiple referees and pick up on hand signals. In this way, the on court referee can more accurately control both the shot clock and the game clock directly but a swift click of a button on the handheld module. In this way, the present disclosure provides solutions to long felt problems plaguing the art.

Scoreboard Controller:

In the arrangement shown, as one example, system 10 also includes a scoreboard controller 40. Scoreboard controller 40 is formed of any suitable size, shape, and design and is configured to receive inputs from live action and from users such as referees and officials and manipulate this input to send signals to the scoreboard 30 to display the appropriate information.

Said another way, a scoreboard controller 40 is a physical controller that act as the brains and/or host that controls all of the components in the system and send the correct values to be displayed on the scoreboard 30. Conventional scoreboard controllers 40 appear as a keyboard which provides input for an operator to run and/or change the scoreboard 30. In this way, conventional scoreboard controllers can be difficult to operate because there is not an interactive screen as many users have grown used to with other devices.

In the arrangement shown, as one example, system 10 provides a plurality of handheld devices that can be used to remotely manage the scoreboard controller. In this way, the referee can directly manage, manipulate and/or control the scoreboard controller 40. In the arrangement shown, the scoreboard controller 40 received signals and starts and/or stops the shot clock and the scoreboard. The instant and whistle detection systems are able to directly control the starting and/or stopping of the scoreboard via direct routing to and from the scoreboard controller 40.

Handheld Remote:

In the arrangement shown, system 10 may include a handheld remote 50. Handheld remote 50 is formed of any suitable size, shape, and design and is configured to provide a referee and/or other user with a convenient, lightweight, easy to use handheld device that can be carried with the referee during an event. In this way, the referee has direct access to a convenient handheld sized remote whether located in the referee's hand and/or located on the referee's belt or hip and the like.

In the arrangement shown, as one example, handheld remote 50 sends a signal to the console host (to be further discussed herein). In turn, the console host sends the signal to the scoreboard controller. In this way, conventional handheld remote controllers are modified within the system to be controlled in various ways.

Console Host:

In the arrangement shown, as one example, system 10 includes a console host 70. Console host 70 is formed of any suitable size, shape, and design and is configured to accept a variety of inputs and control a scoreboard controller. In this way, the console host 70 can be easily configured into an existing system and/or easily installed with a new system.

In the arrangement shown, as one example, the console host acts as the brains of the operation. The console host collects signals from the plurality of belt packs and sends the corrected signals to the existing scoreboard controller. In this way, the console host can tell the scoreboard controller what operations to conduct and/or what information to display and/or change on a scoreboard.

In the arrangement shown, as one example, the console host 70 automates actions that would be triggered by a shot clock operator under conventional operating conditions. In the arrangement shown, as one example, the console host 70 creates a system where the shot clock and game clock operators need not interfere with the system 10. In this way, human reaction time and human error are eliminated.

Remote Pack:

In the arrangement shown, as one example, system 10 includes a remote pack 80. Remote pack 80 and/or plurality of remote packs 80 are formed of any suitable size, shape, and design and are configured to provide direct access for a referee to control various functions of any event. In the arrangement shown, as one example, remote pack 80 is a wallet sized and/or conveniently sized pack which appears on the hip of a referee but may also be located on other places as desired.

In the arrangement shown, as one example, remote pack 80 (also known as "belt pack") is a small "pager" sized device worn by the referee. In the arrangement shown, as one example, the whistle microphone is attached to the belt pack 80. In this way, the whistle microphone can detect when whistles are blown, transmit this information to the belt pack, and the belt pack can wirelessly transmit this information to the console host. In this way, the signal can be sent directly from the referee without the referee doing anything but blowing a whistle. In this way, the referee automatically triggers game clock start and game clock stop when the referee blows the whistle. In this way, the referee need not even manually press any button or perform any other manipulations outside of conventional referee activity, such as blowing a whistle when necessary in a game.

Activator:

In the arrangement shown, as one example, system 10 includes an activator 90. Activator 90 is formed of any suitable size, shape, and design and is configured to be the trigger by which activities and/or signals are sent in the system 10. In the example, above, the activator 90 is formed of a whistle and a microphone. In this example, the whistle microphone acts as the activator. In this example, whenever the referee blows the whistle, the microphone detects the frequency and sends the signal to the console host. This is one means of an activator 90.

Additionally, as explained herein in another example, the activator 90 may be a handheld device which has a plurality of buttons. Additionally, and in another arrangement, an activator 90 may be a mouthpiece and or mouthguard with a transceiver such that a referee simply need apply pressure with a bite to transmit a signal. In this arrangement a referee biting the device and/or biting the activator acts with the same consequence as a whistle blow. Effectively, a referee and/or single person can manage both game clock and shot clock with a simple bite on a device.

Other Devices:

In the arrangement shown, as one example, system 10 may include a plurality of devices such as horns, lights, synchronization screens, and the like which can all be attached to system 10 and/or manipulated by system 10.

Graphical User Interface:

In the arrangement shown, as one example, system 10 includes a graphical user interface 120. Graphical user interface 120 is formed of any suitable size, shape, and design and is configured to present the user with an easy to use display system and easy to use system for creating rules, setting up systems, managing systems, and generating reports, and the like.

Additionally, graphical user interface 120 is configured to generate reports related to an event and/or sporting data which provide results and/or suggestions for the performance of an officiating crew and the like and of potential health and/or safety hazards. Said another way, graphical user interface 120 is configured to allow users to set up online scenarios of real world and/or potential real world situations in which a user can identify, measure, analyze, compute, and make changes for a plurality of event and/or sporting scenarios. Additionally, graphical user interface 120 is configured to provide a plurality of users with access to these services in an easy to use way such that a user need not be a highly qualified users to perform the identification and analysis, or any other steps of the process (as disclosed further herein).

Furthermore, graphical user interface 120 provides an easy way for a user, experienced or inexperienced, to upload information to a database, enter information into a database, storing that information, sharing that information, interpolating this information, and using that information to provide resolutions and/or measurable standardized easy to interpret reports, among other services, as well as mitigation options. Graphical user interface 120 is an exemplary method by which systems of the present disclosure may represent, provide, connect, book, retrieve, and organize, and report, and more.

In the arrangement shown, as one example, graphical user interface 120 includes a plurality of tabs including but not limited to a game operations tab, a time indicator 122, an elapsed time 124, a plurality of official packs 126, an event tracker 128, a source 130, an event title 132, a game clock 134, an event log tab 136, a settings tab 138, and a plurality of settings, among other pages, features, and other components.

Methods of Use:

As one example, a system and method using an activator to send a signal directly from an on court official to manipulate a shot clock is disclosed. The activators of this method can be various from a whistle microphone, to a handheld device with a plurality of buttons, to a mouthguard and/or mouthpiece with a means of sending a signal. These and other methods of use are hereby contemplated for use.

It will be appreciated by those skilled in the art that other various modifications could be made to the device without parting from the spirit and scope of this disclosure. All such modifications and changes fall within the scope of the claims and are intended to be covered thereby.

What is claimed:

1. A system for managing time in an event, the system comprising:
- a scoreboard;
- a scoreboard controller;
- a console host;
- an activator;
  - wherein the activator is triggered when a whistle is blown;
  - wherein the activator senses the use of the whistle;
  - wherein the activator sends a signal to the console host;
- a plurality of wired connections;
  - wherein the plurality of wired connections services the scoreboard controller as connected to receiving devices;
- wherein the console host causes a game clock to stop when the whistle is blown;
- wherein upon the subsequent whistle, the activator senses the blow of the whistle and causes the console host to start the game clock;
- a graphical user interface;
  - the graphical user interface having a display screen;
  - the display screen displaying a game clock time remaining;
  - the display screen displaying a shot clock time remaining;
- a computer system;
- wherein the computer system is configured to process signals;
  - wherein the computer system is configured to provide processing for setting up a plurality of parameters associated with a sporting event;
- the display screen displaying an event log;
  - the event log tracking all events occurring within the system in chronological order:
- the display screen displaying all connected devices.

2. The system of claim 1, further comprising:
- a plurality of handheld remotes;
  - wherein a user activates at least one button on the handheld remote;
  - wherein the user can override the activation of a whistle with the handheld remote.

3. The system of claim 1, further comprising:
- wherein the activator is a whistle;
- a whistle microphone;
  - wherein the whistle microphone detects when a whistle has been activated.

4. The system of claim 1, further comprising:
- a plurality of handheld remotes;
  - wherein a user activates at least one button on the handheld remote;
  - wherein the activation of at least one button on the handheld remote sends a signal to the console host;
- wherein the console host causes a game clock to stop when a stop button of the handheld remote is pressed;
- wherein the console host causes a game clock to start when a start button of the handheld remote is pressed.

5. The system of claim 1, further comprising:
- a geographic location;
  - the geographic location having a defined space.

6. The system of claim 1, further comprising:
- a plurality of handheld remotes;
  - wherein a user activates at least one button on the handheld remote;
  - wherein the activation of at least one button on the handheld remote sends a signal to the console host;
- wherein the console host causes a game clock and a shot clock to stop when a stop button of the handheld remote is pressed;
- wherein the console host causes a game clock and a shot clock to start when a start button of the handheld remote is pressed.

7. The system of claim 1, further comprising:
- a plurality of wireless connections.

8. The system of claim 1, further comprising:
- the graphical user interface having a plurality of settings for display options;
  - wherein the display options can change parameters displayed on the graphical user interface display.

9. The system of claim 1, further comprising:
- a horn.

10. The system of claim 1, further comprising:
- a plurality of handheld remotes;
- wherein each of the plurality of handheld remotes includes a remote display.

11. A system for managing time in an event, the system comprising:
- a scoreboard;
- a scoreboard controller;
- a console host;
- an activator;
  - wherein the activator sends a signal to the console host;
- a scoreboard controller;
  - wherein the console host sends signals to the scoreboard controller;
- wherein the console host causes a game clock to stop when a signal is sent from a handheld remote;
- wherein upon a subsequent signal sent from a handheld remote, the console host resumes the game clock;
- a graphical user interface;
  - the graphical user interface having a display screen;
  - the display screen displaying a game clock time remaining;
  - the display screen displaying a shot clock time remaining;
- a computer system;
- wherein the computer system is configured to process signals;

wherein the computer system is configured to provide processing for setting up a plurality of parameters associated with a sporting event;

the display screen displaying an event log;

the event log tracking all events occurring within the system in chronological order;

the display screen displaying all connected devices.

12. The system of claim 11, further comprising:

a whistle.

13. The system of claim 11, further comprising:

wherein the activator is a whistle;

a whistle microphone;

wherein the whistle microphone detects when a whistle has been activated.

14. The system of claim 11, further comprising:

wherein the activator is a combination of a plurality of handheld devices and whistles.

15. The system of claim 11, further comprising:

the graphical user interface having a plurality of settings for display options;

wherein the display options can change parameters displayed on the graphical user interface display.

16. A method for remotely controlling the time management of an event, further comprising:

providing a scoreboard; the scoreboard displaying a plurality of parameters associated with an event;

providing a scoreboard controller; wherein the scoreboard controller manipulates the parameters associated with an event;

providing a console host; wherein the console host is inline with signals sent to the scoreboard controller;

providing an activator;

activating the activator so that a signal is sent from the activator to the console host and to the scoreboard controller so that any one of a plurality of parameters is manipulated on the scoreboard;

providing a graphical user interface with a graphical user interface display;

displaying a game clock status;

displaying a score;

displaying an event log and history of events;

displaying a plurality of connected devices; wherein the connected devices are remote devices connected to the console host wirelessly.

17. The method of claim 16, further comprising:

wherein the activator is a whistle microphone; wherein the whistle microphone is configured to detect the activation of the frequency of a whistle.

18. The method of claim 16, further comprising:

wherein the activator is a handheld device with a plurality of buttons; wherein the handheld device is configured to send a signal to the console host when a button is pressed.

19. The method of claim 16, further comprising:

wherein the activator is a mouthpiece; wherein when the mouthpiece is activated, the mouthpiece sends a signal to the console host.

* * * * *